US010287667B2

(12) United States Patent
Cotton et al.

(10) Patent No.: US 10,287,667 B2
(45) Date of Patent: May 14, 2019

(54) PROCESS FOR TREATING A PIECE OF TANTALUM OR OF A TANTALUM ALLOY

(71) Applicant: COMMISSARIAT A L'ENERGIE ATOMIQUE ET AUX ENERGIES ALTERNATIVES, Paris (FR)

(72) Inventors: Dominique Cotton, Dijon (FR); Sebastien Faure, Dijon (FR); Philippe Jacquet, Cluny (FR); Vincent Vignal, Binges (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 519 days.

(21) Appl. No.: 15/189,778

(22) Filed: Jun. 22, 2016

(65) Prior Publication Data

US 2016/0376692 A1 Dec. 29, 2016

(30) Foreign Application Priority Data

Jun. 25, 2015 (FR) ..... 15 55872

(51) Int. Cl.
*C22F 1/02* (2006.01)
*C22F 1/18* (2006.01)
(Continued)

(52) U.S. Cl.
CPC ..... *C23C 8/20* (2013.01); *C22C 27/02* (2013.01); *C22F 1/02* (2013.01); *C22F 1/18* (2013.01)

(58) Field of Classification Search
CPC ..... C23C 8/20; C23C 8/06
(Continued)

(56) References Cited

U.S. PATENT DOCUMENTS 3,163,563 A 12/1964 Douglass et al.
4,664,722 A * 5/1987 Clinkscales ..... C21D 1/72 148/212
(Continued)

FOREIGN PATENT DOCUMENTS

EP 1 666 413 A1 6/2006
GB 702936 1/1954

OTHER PUBLICATIONS

French Preliminary Search Report dated Apr. 15, 2016 in French Application 15 55872 filed on Jun. 25, 2015 ( with English Translation of Categories of Cited Documents).

*Primary Examiner* — Colleen P Dunn
*Assistant Examiner* — Rajinder Bajwa
(74) *Attorney, Agent, or Firm* — Oblon, McClelland, Maier & Neustadt, L.L.P.

(57) ABSTRACT

A process for treating a piece of tantalum or of a tantalum alloy, which consists in: placing the piece in a furnace and heating the furnace under vacuum at least at 1 400° C.; forming a carbon multilayer in the peripheral part of the piece, by injecting, in the heated furnace, a gas carbon source at a pressure ≤10 mbar, the multilayer comprising at least one layer C1 of tantalum carbide, which is located at the surface of the piece, and two layers C2 and C3 comprising a carbon content lower than the carbon content of the layer C1; stopping the formation of the multilayer by cooling the piece; placing around the piece a device capable of trapping carbon, oxygen and nitrogen to protect the piece from carbon and oxygen and nitrogen traces present in the furnace; causing the diffusion of carbon present in the layer C1 towards the layers C2 and C3, by heating the furnace under vacuum, the piece being held in the protecting device; and stopping the diffusion of carbon in the piece by cooling the piece under vacuum before the carbon present in the multilayer reaches the center part of the piece. Thus, a piece
(Continued)

the surface of which is free from TaC, the center part of which is free from carbon and the part of which located between the surface and the center part comprises tantalum and carbon is obtained.

8 Claims, 6 Drawing Sheets

(51) Int. Cl.
*C23C 8/20* (2006.01)
*C22C 27/02* (2006.01)

(58) Field of Classification Search
USPC ..... 148/213
See application file for complete search history.

(56) References Cited

U.S. PATENT DOCUMENTS

| | | | | |
|---|---|---|---|---|
| 5,383,981 | A * | 1/1995 | de Pruneda | C22C 27/02 148/206 |
| 5,916,377 | A | 6/1999 | Lopez et al. | |
| 7,524,382 | B2 * | 4/2009 | Fink | C23C 8/02 148/206 |
| 2007/0059501 | A1 * | 3/2007 | Kaneko | C23C 8/02 428/209 |

* cited by examiner

PROCESS FOR TREATING A PIECE OF TANTALUM OR OF A TANTALUM ALLOY

TECHNICAL FIELD

The present invention relates to the carburising treatment of a metal piece of tantalum or of a tantalum alloy, in order to make it more mechanically and chemically resistant.

In particular, the process according to the invention makes it possible to form at the surface of the piece of tantalum or of a tantalum alloy one or more layers of tantalum carbide, by controlling their structures and thicknesses.

The fields of application of such a process are numerous and all are fields requiring making resistant pieces of tantalum or of a tantalum alloy (manufacturing crucibles for metallurgy, electrodes, lamp filaments, resistors, tooling, etc.).

STATE OF PRIOR ART

Tantalum is a highly corrosion-resistant material and has a very high melting point (T melting ≥3 000° C.). Pieces of tantalum or of a tantalum alloy are thus used in many fields and in particular for manufacturing crucibles usable in pyrochemistry.

In order to make these pieces even more resistant to corrosion and increase their hardness, it is possible for them to undergo carburising, that is a thermochemical treatment which consists in increasing the surface carbon content of the piece. A subsequent (chemical, mechanical or heat) treatment can then be implemented in order to obtain a particular surface microstructure.

Three carburising types are discriminated depending on the state of the carburising medium, that is solid carburising, liquid carburising and gas carburising. Among these three carburising types, four important carburising methods (mainly developed for steels) are commonly described in literature, that is pack carburising, controlled atmosphere carburising, low pressure carburising and plasma-assisted carburising.

In pack carburising, the piece to be carburised is directly put in contact with solid carbon. Once it is sublimated, the solid carbon that became gaseous will be adsorbed at the surface of the piece, and then diffused in the piece to react with tantalum. This pack carburising method requires to have a sufficiently high carbon vapour pressure for the tantalum to be properly carburised, which requires very high carburising temperatures (>2 000° C.) and a long heating time (for example 10 h at 1 700° C. in document [1]). Further, this method requires to press the carbon powder on the surface of the piece to be carburised and is thus not applicable to pieces having a complex geometry. Further, because of the solid/solid interface, the carbon feed at the surface is heterogeneous.

Controlled atmosphere carburising consists in placing the piece to be carburised in a controlled atmosphere furnace, heating the furnace until a carburising temperature (>1 200° C. for tantalum) is reached, and then injecting under a pressure of about 1 bar a mixture of an inert gas (argon) and a fuel gas (generally, a methane, acetylene, propane type hydrocarbon, etc.). In some applications, an air/methanol or nitrogen/methanol mixture can also be employed. The fuel molecules then come to be cracked at the surface of the piece to be carburised and release their carbon, which diffuses and then reacts with the surface tantalum. This carburising method however has the drawback to generate oxides when an oxygen compound is injected. Further, when a hydrocarbon is used, it is common that soot is formed inside the furnace enclosure, polluting the same and disturbing the piece carburising.

Low pressure carburising (also known as reduced pressure carburising) consists in placing the piece to be carburised in a thermochemical treatment furnace, and then placing the furnace enclosure under vacuum. The enclosure is then heated until the carburising temperature is reached, and then a gas hydrocarbon (methane, acetylene, propane, etc.) is injected under a low pressure (that is a pressure lower than 100 mbar ranging from a few millibars to a few tens of millibars). This method is recognised to efficiently carburise pieces having very complex geometries and enables the pollution of pieces to be reduced. It is this carburising method that will be used within the scope of the present invention.

Finally, plasma-assisted carburising is very close to low pressure carburising. The main interest of this technique resides in the creation of a plasma around the piece to be carburised. This plasma activates the surface of the material and thus facilitates the diffusion of carbon into the piece. This method is practical for carburising pieces having very complex geometries. However, it remains poorly developed with respect to low pressure carburising, because it requires the use of very specific equipment. One of these main drawbacks is that it does not make it possible to treat pieces having singularities as holes with low diameters, these singularities possibly generating a hollow cathode phenomenon (local melting inside the hole). Further, the bearing face of the pieces on the basket of the treating furnace is never treated, because it is never in direct contact with the plasma.

These four carburising methods make it possible to obtain a heterogeneous structure, comprised at the surface of a TaC layer, and then, moving closer to the piece core, of a $Ta_2C$ sub-layer and then a layer of tantalum saturated with carbon, having possibly $Ta_2C$ precipitates at the grain boundaries depending on the carbon saturation degree of tantalum (a layer that will be also called "C saturated Ta layer" or, if it has $Ta_2C$ precipitates at the grain boundaries, "C saturated Ta+$Ta_2C$ layer"). The greater the carbon enrichment, the higher the thickness of the TaC layer with respect to the thicknesses of the $Ta_2C$ layer and C saturated Ta layer (or C saturated Ta+$Ta_2C$ layer). If the carbon enrichment is sufficiently high, it is thus possible to fully convert the tantalum of the piece into tantalum carbide TaC.

Regardless of the carburising method used, a TaC layer is thus always obtained at the surface of the piece. However, for some applications, it is not desirable to have such a layer at the surface of the piece and accordingly, it is necessary to remove it.

To remove this surface layer, a surface chemical treatment by acid attack can be conducted. By way of example, such a surface chemical treatment is described in document [1]. The drawback of surface chemical treatments is that they modify the surface state of the pieces and are difficult to implement because of high hardness and high chemical inertia properties of carbides towards acids. It is thus necessary to use very strong acid mixtures (the most common being a mixture of nitric, hydrofluoric and lactic acids), which are generally toxic and very hazardous to use. Further, the chemical attack will attack all the carbide layers (TaC layer and the underlying $Ta_2C$ layer) and not only the surface layer of TaC, to leave only the layer having a carbon saturated tantalum structure with $Ta_2C$ at the grain boundaries.

DISCLOSURE OF THE INVENTION

The invention aims at solving at least partially the problems encountered in the solutions of prior art.

To that end, one object of the invention is to provide a process for treating a piece of tantalum or of a tantalum alloy, comprising the steps of:

a) placing the piece in a furnace and heating the furnace under vacuum at a temperature at least equal to 1 400° C.;

b) forming a carbon multilayer in the peripheral part of the piece, by injecting, in the heated furnace, a gas carbon source at a pressure at most equal to 10 mbar, the carbon multilayer comprising at least one layer C1 of tantalum carbide, which is located at the surface of the piece, and two underlying layers C2 and C3 each comprising a carbon content which is different and lower than the carbon content of the layer C1;

c) stopping the formation of the carbon multilayer by cooling the piece;

d) placing around the piece a protecting device capable of trapping carbon, oxygen and nitrogen to protect the piece from carbon as well as possible oxygen and nitrogen traces present in the furnace;

e) causing the diffusion of all or part of the carbon present in the layer C1 towards the layers C2 and C3, by heating the furnace under vacuum, the piece being held in the protecting device; and f) stopping the diffusion of carbon in the piece by cooling the piece under vacuum before carbon present in the carbon multilayer reaches the centre part of the piece;

whereby a piece the surface of which is free from tantalum as TaC, the centre part of which is free from carbon and the part of which (hereinafter "intermediate part"), located between the surface and the centre part comprises tantalum and carbon is obtained.

In the process object of the invention, the diffusion in step e) causes the decomposition of all or part of the carbides present in the layer C1. Thus, depending on the temperature and the heating time, the tantalum carbide TaC of the layer C1 will be mainly decomposed into tantalum carbide $Ta_2C$, and then in carbon saturated tantalum having $Ta_2C$ at the grain boundaries. Thus, the surface of the piece (which will be called "surface layer" below) is free from TaC type tantalum carbide, but, since the decomposition begins close to the surface, the thickness of this surface layer may correspond to the thickness of the layer C1 of the carbon multilayer or to an upper part of the layer C1.

The process object of the invention makes it possible, by a same series of steps, to carburise a piece while choosing the structure and chemical composition of the surface layer of the carburised piece obtained at the end of the process, without having to use a chemical treatment with acids or a mechanical treatment of the surface of the piece. For example, for a tantalum piece, at the end of the steps of the process, a surface layer of $Ta_2C$ type tantalum carbide or carbon saturated tantalum having $Ta_2C$ at the grain boundaries may be chosen. Multilayer structures can then be obtained, for example of the type:

$Ta_2C$/C sat. Ta+$Ta_2C$ (that is with, in the surface layer, $Ta_2C$ and, in the intermediate part of the piece, a layer of carbon saturated Ta with $Ta_2C$ at the grain boundaries);

$Ta_2C$/TaC/$Ta_2C$/C sat. Ta+$Ta_2C$ (that is with, in the surface layer, $Ta_2C$, and, in the intermediate part of the piece, a TaC layer, a $Ta_2C$ layer and a carbon saturated Ta layer with $Ta_2C$ at the grain boundaries); or even carbon saturated Ta+$Ta_2C$/$Ta_2C$/carbon saturated Ta+$Ta_2C$ (that is with, in the surface layer, carbon saturated Ta with $Ta_2C$ at the grain boundaries, and, in the intermediate part of the piece, a $Ta_2C$ layer and a carbon saturated Ta layer with $Ta_2C$ at the grain boundaries);

these multilayer structures being on a centre part of tantalum or of a tantalum alloy.

A surface layer of C sat. Ta+$Ta_2C$ can also be simply on a centre part of tantalum or of a tantalum alloy.

It is to be noted that in the examples recited above, the C sat. Ta+$Ta_2C$ layer can also be a C sat. Ta layer, if the carbon saturation degree of the tantalum layer is lesser.

It is to be noted that in document [2] is described a process comprising forming carbide layers at the surface of a piece of tantalum or of a tantalum alloy, followed by applying a heat treatment which is implemented in order to carburise the entire piece. Thus, unlike the process object of the invention in which it is desired to preserve tantalum or a tantalum alloy at the piece core, the process described in document [2] has the purpose to make a carbon saturated piece ("C sat. Ta" or "C sat. Ta+$Ta_2C$" piece) throughout its thickness. Further, the process described does not afford complex multilayer structures of the "carbon poor layer/carbon rich layer/carbon poor layer" type on a core of tantalum or of a tantalum alloy, as for example those illustrated in FIGS. 5*b* and 6*b* hereinafter (that is $Ta_2C$/TaC/$Ta_2C$/C sat. Ta+$Ta_2C$/core and C sat. Ta+$Ta_2C$/$Ta_2C$/C sat. Ta+$Ta_2C$/core).

Within the scope of the present invention, it is considered that a tantalum alloy corresponds to an alloy comprising at least 90% weight tantalum. Further, it is a metal alloy, that is a mixture of tantalum with another metal. It can be for example a TaW alloy.

Preferably, step a) comprises:

introducing the piece into the furnace;

putting the furnace under vacuum; and gradually heating the furnace until a working temperature between 1 500 and 1 700° C. is reached.

Preferably, step b) comprises injecting, preferably continuously, the gas carbon source in the furnace at a flow rate between 1 and 100 $L \cdot h^{-1}$ and, preferably, at an injection pressure lower than or equal to 10 mbar. The injection duration depends on the carbon amount desired to be introduced in the peripheral part of the piece of tantalum or of a tantalum alloy. This duration depends on the injection parameters of the carbon source, the surface of the piece, as well as the thickness and the type of carbon multilayer desired to be obtained.

Preferably, the injection of the gas carbon source in step b) is made at an injection pressure of 5 mbar for a flow rate of 20 $L \cdot h^{-1}$ and in a furnace heated at a temperature of 1 600° C.

Preferably, the gas carbon source used in step b) is ethylene. The choice of ethylene has the advantage to allow a low carbon feed and to limit the formation of possible soot appearing upon using carbon rich gases, as acetylene for example.

Step c) has the purpose to stop the formation of the carbon multilayer; in other words, it is attempted with this step to stop the carbon feed in the piece. Preferably, step c) comprises injecting gas nitrogen in the furnace under a pressure of 1 bar, which enables a quick cooling of the piece to be achieved.

Preferably, step d) comprises:

placing the piece in a closed cavity the walls of which are of a material attracting carbon, oxygen and nitrogen (the material chosen should of course support the treatment temperatures prevailing in the furnace), said material being preferably of tantalum; and draining the cavity using an inert gas so as to discharge from the furnace any gas likely to contain at least one of the atomic elements chosen from carbon, oxygen and nitrogen.

Step e) comprises heating the piece at a temperature sufficient to allow diffusion of carbon present in the layer C1 of the carbon multilayer towards the layers C2 and C3. Preferably, step e) comprises heating the furnace at a temperature of 1 600° C. and at a pressure of $10^{-2}$ mbar.

In step f), the cooling is made under vacuum in order to protect the piece of tantalum or of a tantalum alloy from possible traces of residual pollutions of the furnace which could be driven to the piece if the furnace were repressurised at a high temperature.

The process object of the invention comprises many advantages.

First, the carbon feed in the peripheral part of the piece is controlled and regulated, because it only comes from the gas carbon source used during step b) of the process object of the invention, the carbon being then prevented from being fed by steps c) and d) of the process. Thus, even if carbon remains on the furnace walls (as soot for example, or simply if a furnace having carbon walls is used) and carbon is found in the atmosphere of the furnace in step e) because of the heating of the furnace, it will be trapped by the protecting device and will not be introduced into the piece. It is thus possible to achieve a carburising on a controlled thickness of the peripheral part of the piece, while preserving in the centre part of the piece the properties of the original metal and having at the surface a surface layer which does not contain tantalum carbide TaC.

On the other hand, the use of a low pressure carburising method (steps a) and b) of the process) makes it possible to work at a lower temperature than with other known carburising methods, and the control of the carbon feed enables treatment durations to be optimised which, finally, enables time, energy and supplies to be saved.

No chemicals difficult to implement are used to eliminate the TaC type tantalum carbide from the surface layer of the piece and there is no pollution with oxygen and nitrogen in the treated piece.

Finally, the process object of the invention can be used to treat pieces having complex geometries and/or having singularities (holes with small diameters, etc.).

Further characteristics and advantages of the invention will appear from the additional description that follows and which relates to exemplary implementations of the manufacturing process according to the invention.

It goes without saying that this additional description is only given by way of illustrative purposes of the object of the invention and should not in any way be construed as limiting this object.

Figure 1A:
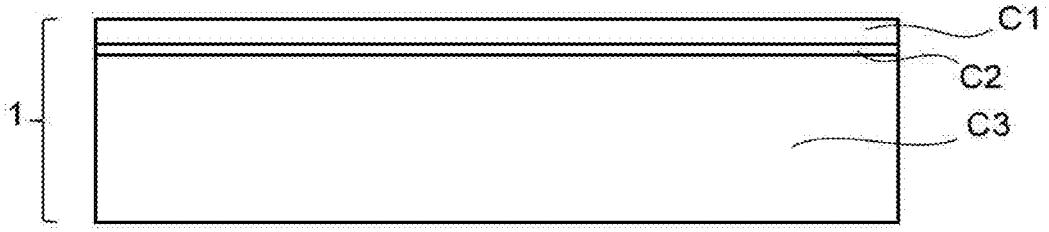
FIG. 1*a* is a schematic cross-section view of a portion of a tantalum piece obtained at the end of step b) of the process object of the invention according to a particular embodiment (1 hour of carburising at 1 600° C.) and showing the carbide layers created at the surface of the piece.

It is to be noted that in the figures above, the centre part of the piece is never represented.

DETAILED DISCLOSURE OF PARTICULAR EMBODIMENTS

The process object of the invention enables the carburising of a piece of tantalum or of a tantalum alloy to be controlled, while choosing the nature and crystal structure of the surface layer of the piece. Indeed, it helps in the choosing of obtaining, at the surface of the piece, a surface layer of $Ta_2C$ type tantalum carbide with an underlying layer of TaC type tantalum carbide or of carbon saturated tantalum with $Ta_2C$ at the grain boundaries, a mixed surface layer consisting of carbon saturated tantalum with $Ta_2C$ at the grain boundaries, or even a surface layer of carbon saturated tantalum with an underlying layer of $Ta_2C$ type tantalum carbide, while controlling the thickness of this surface layer.

As mentioned previously, the heating duration in step b) of the process object of the invention depends on the carbon amount desired to be fed to the piece. The heating duration in step e) is in turn a function of the nature of the layer desired to be obtained at the surface, as well as on the thickness desired for it. By varying these parameters, single layer structures (a surface layer of $Ta_2C$, C sat. Ta+$Ta_2C$ or C sat. Ta on a core of tantalum or of a tantalum alloy) or even multilayer structures ($Ta_2C$/TaC/$Ta_2C$/C sat. Ta+$Ta_2C$ layers; C sat. Ta+$Ta_2C$/$Ta_2C$/C sat. Ta+$Ta_2C$ layers; etc., on a core of tantalum or of a tantalum alloy) can be obtained. Obtaining these different structures enables the hardness and/or corrosion resistance of the piece to be enhanced, in order to make it compatible with its final use.

To illustrate the invention, a preferred embodiment of the process object of the invention will now be described.

A piece of tantalum, for example a crucible having a diameter of 100 mm, for a thickness of 1.5 mm and a height of 150 mm is used.

The piece to be treated is installed in the enclosure of a furnace, for example a furnace with the brand BMI bearing the reference BMICRO.

Then, the furnace enclosure is put under vacuum until a pressure of $10^{-2}$±0.01 mbar is reached.

After the pressure is stabilised, the enclosure is heated with a ramp of 30° C./min, until 1 600° C.±1% is reached.

The carburising of the piece is then conducted by injecting in the enclosure a fuel gas under a low pressure (pressure lower than about ten millibars) for a determined duration. In this example, ethylene ($C_2H_6$) is injected into the enclosure under a pressure of 5±1 mbar and under a controlled flow rate of 20 L/h for 1 hour.

A cooling of the piece is then conducted, for example by means of nitrogen injected into the furnace enclosure under a pressure of 1 bar for a duration of 90 minutes.

In the peripheral part of the tantalum piece, a carbon multilayer 1 comprising a surface layer C1 of TaC type tantalum carbide, an underlying layer C2 of $Ta_2C$ type tantalum carbide and an underlying layer C3 of carbon saturated tantalum with $Ta_2C$ precipitates at the grain boundaries (FIGS. 1*a* and 1*b*) are thereby obtained.

Figure 2A:
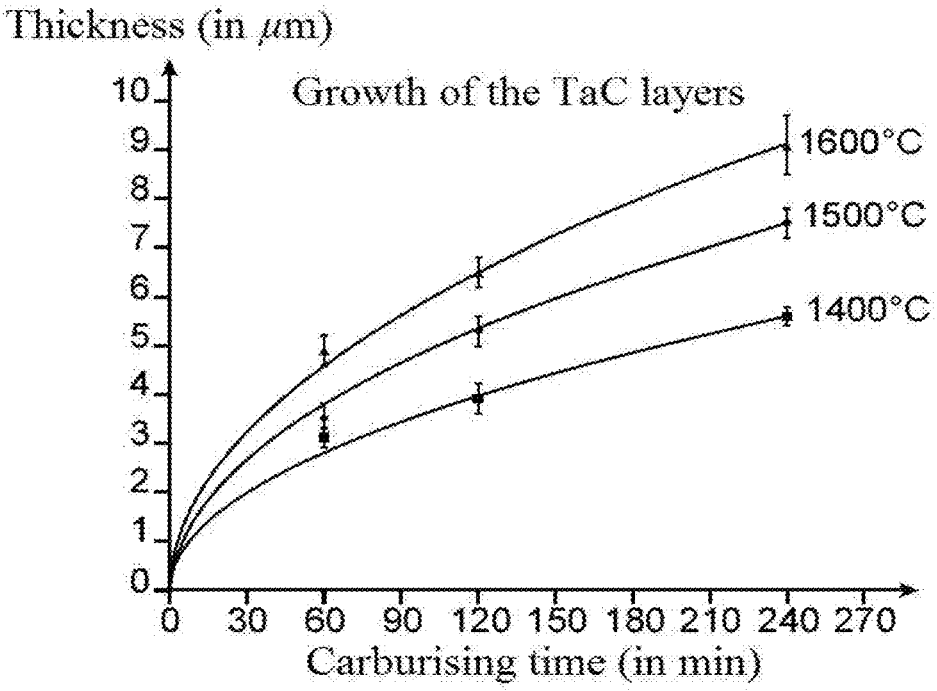
FIGS. 2*a* and 2*b* respectively represent the carburising duration as a function of time at different temperatures for the growth of TaC layers (FIG. 2*a*) and the growth of $Ta_2C$ layers (FIG. 2*b*).
Figure 2B:
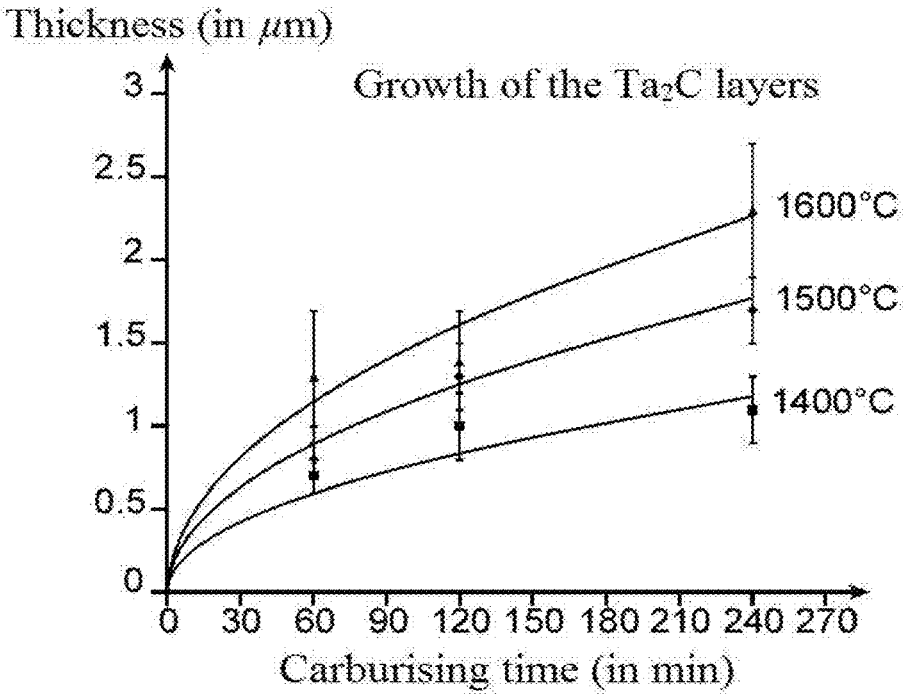

The thickness of the carbon multilayer 1 (and thus the total carbon amount fed in the piece) depends on the time the tantalum piece is held under the flow of fuel gas (FIGS. 2*a* and 2*b*). Indeed, in a known manner, the growth of the layers of tantalum carbides follows the parabolic law $W=\sqrt{kt}$ where W is the thickness of the carbide layer (in μm), t the holding time (in minutes) and k the growth coefficient ($\mu m^2 \cdot min^{-1}$). Analogously, the same formula is applied for the formation of the carbon multilayer 1. The formation speed of the carbon multilayer also depends on the carburising temperature. This formation speed exponentially increases with temperature.

The piece thus treated is then moved away from any carbon source, as well as possible pollutants. This step is necessary if the pollution phenomena of the tantalum should be avoided during the diffusion step and the carbon amount present in the piece should be controlled. Indeed, the tantalum is a very reactive element when hot towards atoms as carbon, oxygen and nitrogen and these elements can for example be found as molecules adsorbed on the walls of the furnace enclosure.

For this, according to a preferred embodiment of the process according to the invention, the piece is placed in a cavity (for example formed by depositing a bell on a support, the bell and the support being both of tantalum) which is placed in the furnace enclosure. This enables pollutant elements (I, $N_2$, etc.), as well as possible carbon atoms present on the walls of the furnace enclosure, to be trapped, before they come in contact with the piece. This also enables gas exchanges to be reduced between the furnace enclosure and the piece to be treated, which turns out to be favourable in the carbon diffusion process.

A double pumping of the furnace enclosure can possibly be conducted by performing an intermediate nitrogen draining (pressure of $10^{-2}$+/−0.01 mbar) in order to discharge any pollutant.

Then, the piece is heated. The heating under vacuum in step e) will enable carbon present in the layer C1 of the carbon multilayer 1 to diffuse to the layers C2 and C3 of the multilayer.

The heating holding time of the set formed by the piece and the protecting device depends on three parameters:

the type of structure desired to be obtained at the end of the process;

the thickness of the multilayer formed during the carburising step;

the thickness of the piece.

The set formed by the piece and the protecting device (cavity) is heated at 30° C./minute until the wanted treatment temperature is reached. It is chosen here to use the same temperature as that used for carburising, that is 1 600° C.+/−1%.

At the end of step b) (after carburising), the tantalum piece included at the surface a carbon multilayer 1 having a surface layer C1 of TaC, an underlying layer C2 of $Ta_2C$ and an underlying layer C3 of carbon saturated tantalum with $Ta_2C$ precipitates at the grain boundaries. During heating in step e), carbon diffuses from the surface layer C1 of TaC (the richest carbon layer) to the layer C2 of $Ta_2C$, and from the layer C2 of $Ta_2C$ to the layer C3 of C sat. Ta+$Ta_2C$. This cascade carbon diffusion causes a decrease in the thickness of the TaC layer in favour of the $Ta_2C$ layer. It is then possible to make totally disappear the TaC layer in favour of a single $Ta_2C$ layer at the surface of the piece. If heating is continued, the $Ta_2C$ layer is also decomposed, therefore disappeared completely. Accordingly, there remains at the surface only carbon saturated tantalum having $Ta_2C$ precipitates at the grain boundaries.

Different structures possibly obtained by varying the heating duration in step b) and/or in step e) are illustrated in the following figures.

Figure 1B:
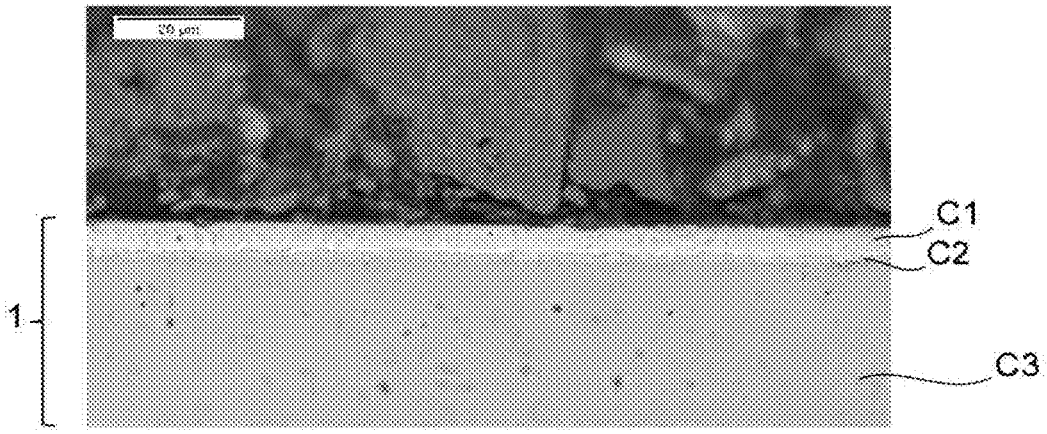
FIG. 1*b* represents a picture obtained by scanning electron microscopy (SEM) of the piece illustrated in FIG. 1*a*.

As mentioned above, after heating the tantalum piece for 1 h at 1 600° C. in step b), a carbon multilayer 1 having a layer C1 of TaC, a layer C2 of $Ta_2C$ and a layer C3 of C sat. Ta+$Ta_2C$ is obtained (FIGS. 1*a* and 1*b*).

Figure 3A:
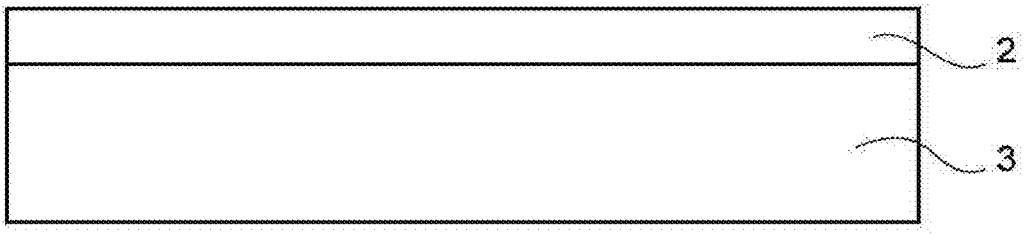
FIG. 3*a* represents a schematic cross-section view of a portion of a tantalum piece obtained according to a particular embodiment of the process object of the invention (1 hour of carburising at 1 600° C., cooling and 1 hour of heating under vacuum at 1 600° C.) and showing the carbide layers created at the surface of the piece.
Figure 3B:
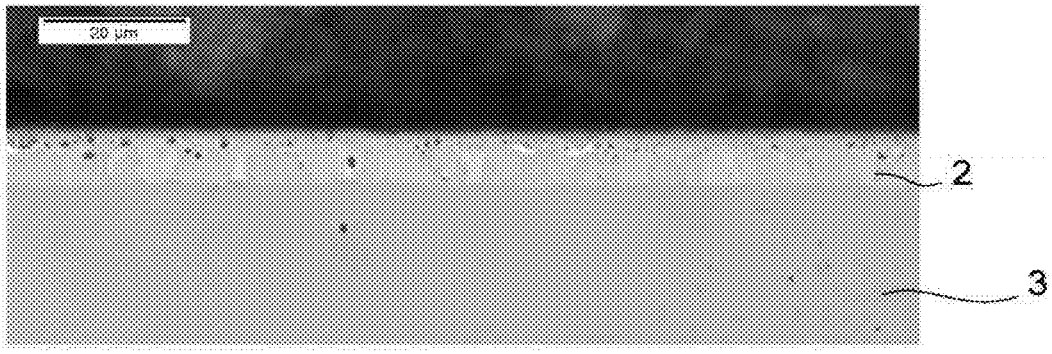
FIG. 3*b* represents a picture obtained by SEM of the piece illustrated in FIG. 3*a*.

If it then undergoes the other steps of the process object of the invention, including 1 h of heating under vacuum at 1 600° C. in step e) after having isolated it from any carbon source, a surface layer 2 of $Ta_2C$ is obtained on an underlying layer 3 of C sat. Ta+$Ta_2C$ (FIGS. 3*a* and 3*b*).

Figure 4A:
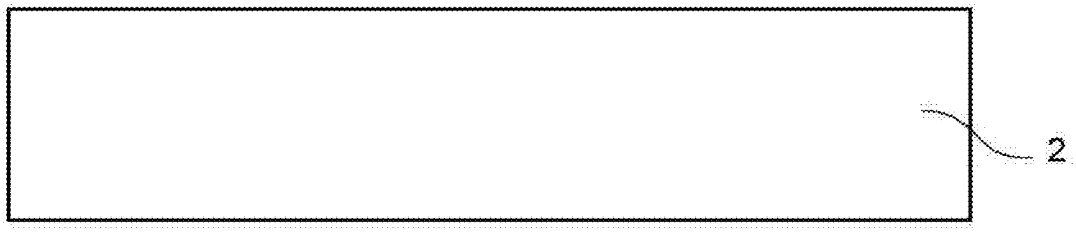
FIG. 4*a* represents a schematic cross-section view of a portion of a tantalum piece obtained according to a particular embodiment of the process object of the invention (with 1 hour of carburising at 1 600° C. in step b) and 6 hours of heating under vacuum at 1 600° C. in step e)).
Figure 4B:
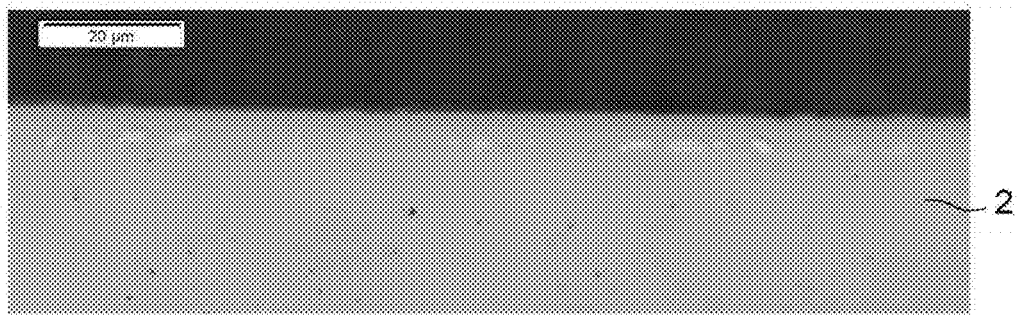
FIGS. 4*b* and 4*c* respectively represent a picture obtained by SEM of the piece illustrated in FIG. 4*a* at two different magnifications. It is to be noted that, in FIG. 4*c*, the piece has undergone a chemical attack in order to reveal the presence and location of $Ta_2C$ precipitates (black spots).
Figure 4C:
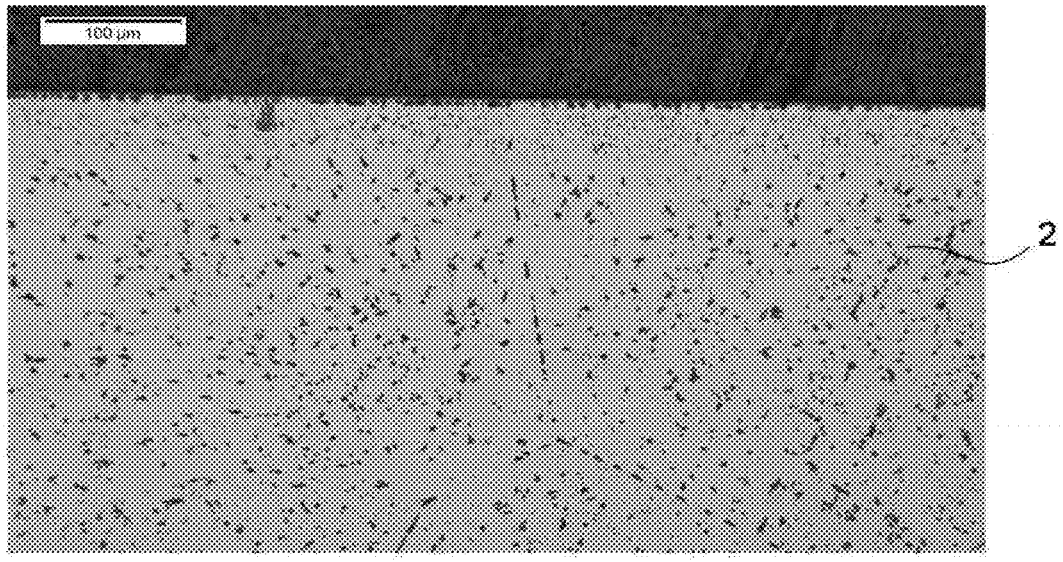

If, on the contrary, the piece provided with the carbon multilayer undergoes heating under vacuum of 6 h at 1 600° C. in step e), a surface layer 2 of carbon saturated tantalum with $Ta_2C$ precipitates at the grain boundaries is obtained (FIGS. 4*a*, 4*b* and 4*c*, the precipitates being visible in black colour in FIG. 4*c*). Here, it can be assumed that carbon diffusion is such that the layers C1, C2 and C3 of the carbon multilayer have transformed into the surface layer 2.

Figure 5A:
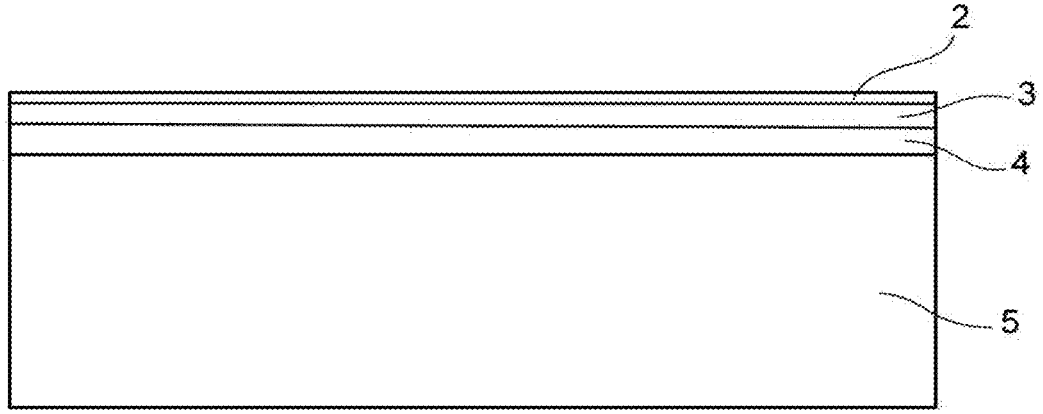
FIG. 5*a* represents a schematic cross-section view of a portion of a tantalum piece obtained according to a particular embodiment of the process object of the invention (with 2 hours of carburising at 1 600° C. in step b) and 30 minutes of heating under vacuum at 1 600° C. in step e)).
Figure 5B:
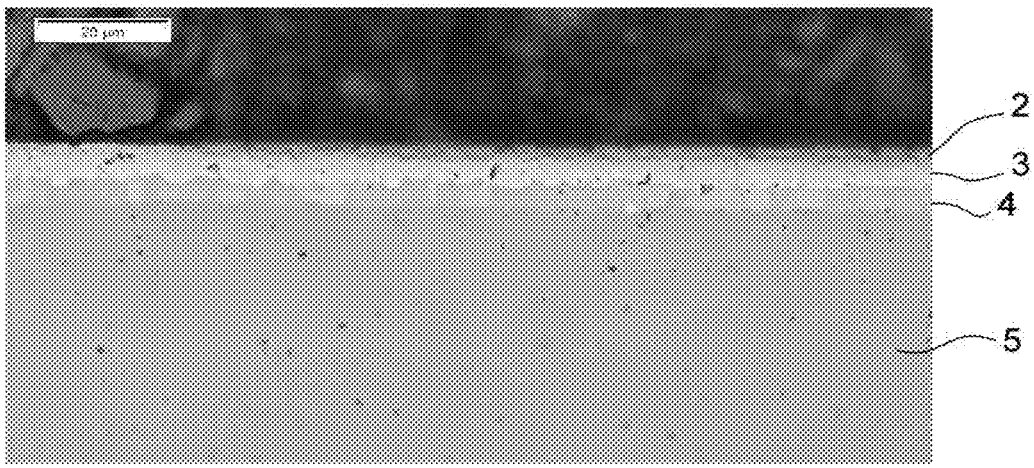
FIG. 5*b* represents a picture obtained by SEM of the piece illustrated in FIG. 6*a*.

According to another example, if the piece has undergone carburising by heating under vacuum at 1 600° C. for 2 h in step b) and heating under vacuum at 1 600° C. for 30 minutes in step e), a piece having a surface layer 2 of $Ta_2C$, a first sub-layer 3 of TaC, a second sub-layer 4 of $Ta_2C$ and a third sub-layer 5 of C sat. Ta+$Ta_2C$ is obtained (FIGS. 5*a* and 5*b*).

Figure 6A:
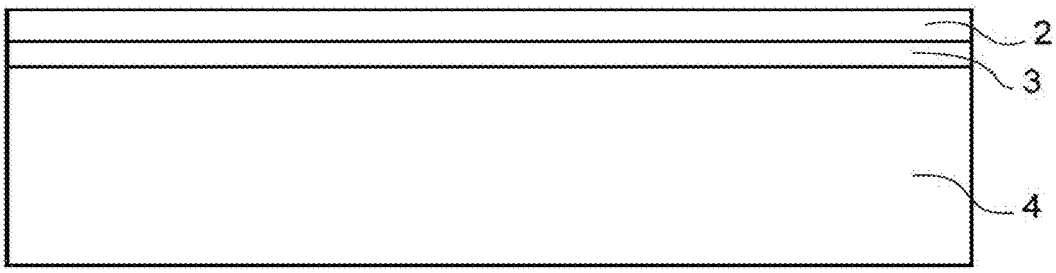
FIG. 6*a* represents a schematic cross-section view of a portion of a tantalum piece obtained according to a particular embodiment of the process object of the invention (with 2 hours of carburising at 1 600° C. in step b) and 6 hours of heating under vacuum at 1 600° C. in step e)).
Figure 6B:
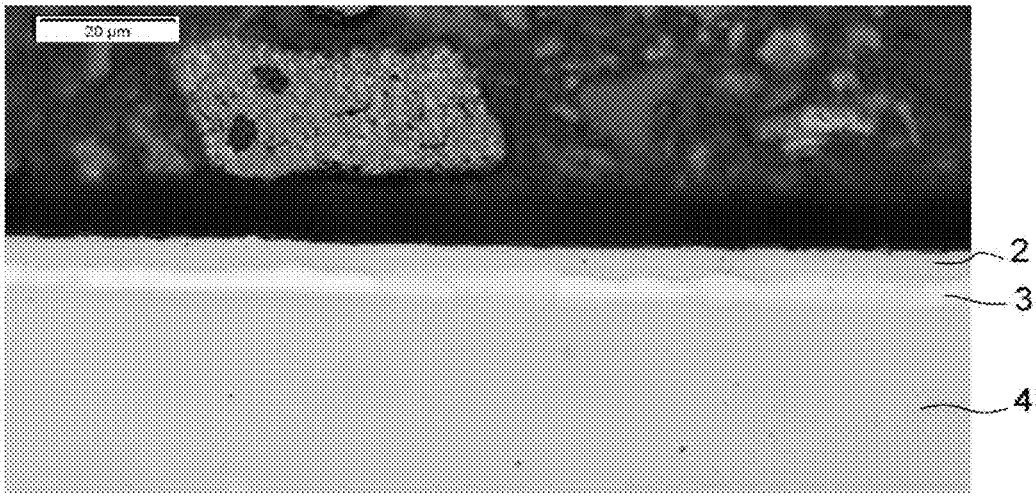
FIG. 6*b* represents a picture obtained by SEM of the piece illustrated in FIG. 6*a*.

If, on the contrary, it undergoes carburising by heating under vacuum at 1 600° C. for 2 h in step b) and heating under vacuum at 1 600° C. for 6 h in step e), a surface layer 2 of C sat. Ta, a first sub-layer 3 of $Ta_2C$ and a second sub-layer 4 of C sat. Ta+$Ta_2C$ are obtained (FIGS. 6*a* and 6*b*).

REFERENCES CITED

[1] U.S. Pat. No. 5,916,377
[2] U.S. Pat. No. 5,383,981

The invention claimed is:

1. A process for treating a piece of tantalum or of a tantalum alloy, the piece having a peripheral part and a centre part, the process comprising the steps of:

a) placing the piece in a furnace and heating the furnace under vacuum at a temperature at least equal to 1 400° C.;

b) forming a carbon multilayer in the peripheral part of the piece, by injecting, in the heated furnace, a gas carbon source at a pressure at most equal to 10 mbar, the carbon multilayer comprising at least one layer C1 of tantalum carbide, which is located at a surface of the piece, and two underlying layers C2 and C3 each comprising a carbon content which is different and lower than a carbon content of the layer C1;

c) stopping the formation of the carbon multilayer by cooling the piece;

d) placing around the piece a protecting device for trapping carbon, oxygen and nitrogen to protect the piece from carbon as well as possible oxygen and nitrogen traces present in the furnace;

e) causing a diffusion of all or part of carbon present in the layer C1 towards the layers C2 and C3, by heating the furnace under vacuum, the piece being held in the protecting device; and f) stopping the diffusion of carbon in the piece by cooling the piece under vacuum before carbon present in the carbon multilayer reaches the centre part of the piece;

whereby a piece the surface of which is free from tantalum as TaC, the centre part of which is free from carbon and a part of which is located between the surface and the centre part comprises tantalum and carbon is obtained.

2. The process of claim 1, wherein step d) comprises:

placing the piece in a closed cavity of the protecting device, the closed cavity having walls made of a material attracting carbon, oxygen and nitrogen; and draining the cavity using an inert gas.

3. The process of claim 1, wherein step a) comprises:

introducing the piece into the furnace;

putting the furnace under vacuum; and heating the furnace until a working temperature between 1 500 and 1 700° C. is reached.

4. The process of claim 1, wherein step b) comprises injecting the gas carbon source in the furnace at a flow rate between 1 and 100 L/h and an injection pressure lower than or equal to 10 mbar.

5. The process of claim 4, wherein the injection of the gas carbon source in step b) is made at an injection pressure of 5 mbar for a flow rate of 20 L/h and in a furnace heated at a temperature of 1 600° C.

6. The process of claim 1, wherein step e) comprises heating the furnace at a temperature of 1 600° C. and at a pressure of $10^{-2}$ mbar.

7. The process of claim 1, wherein the gas carbon source used in step b) is ethylene.

8. The process of claim 2, wherein the material attracting carbon, oxygen and nitrogen is tantalum.

* * * * *